US006865830B2

(12) United States Patent
Gravitt et al.

(10) Patent No.: US 6,865,830 B2
(45) Date of Patent: Mar. 15, 2005

(54) THEATRICAL ADVERTISING DISPLAY

(76) Inventors: Todd James Gravitt, 540 NE. 45st St., Apt. #12, Boca Raton, FL (US) 33431; Kelly Jean Sullivan, P.O. Box 153, Deerfield Beach, FL (US) 33433

( * ) Notice: Subject to any disclaimer, the term of this patent is extended or adjusted under 35 U.S.C. 154(b) by 0 days.

(21) Appl. No.: 10/698,335

(22) Filed: Oct. 31, 2003

(65) Prior Publication Data

US 2004/0140999 A1 Jul. 22, 2004

Related U.S. Application Data

(63) Continuation of application No. 10/085,810, filed on Feb. 28, 2002, now Pat. No. 6,640,475

(60) Provisional application No. 60/296,209, filed on Jun. 7, 2001.

(51) Int. Cl.[7] ..... G09F 11/00

(52) U.S. Cl. ..... 40/1; 40/427; 40/446; 40/455; 40/606.03; 40/717; 40/725

(58) Field of Search ..... 40/1, 124.03, 427, 40/446, 453, 455, 584, 606.03, 717, 725

(56) References Cited

U.S. PATENT DOCUMENTS

| | | | | |
|---|---|---|---|---|
| 3,650,584 A | * | 3/1972 | Goetz et al. | 312/7.2 |
| 4,934,079 A | * | 6/1990 | Hoshi | 40/427 |
| 5,574,494 A | * | 11/1996 | Marics | 725/37 |
| 5,652,606 A | * | 7/1997 | Sasaki et al. | 40/902 |
| 6,677,689 B2 | * | 1/2004 | Marihugh et al. | 307/147 |

* cited by examiner

*Primary Examiner*—Gary C. Hoge
(74) *Attorney, Agent, or Firm*—David W Barman

(57) ABSTRACT

An assembly and method for providing audio/visual advertising to supplement standard print advertising is disclosed and described.

5 Claims, 1 Drawing Sheet

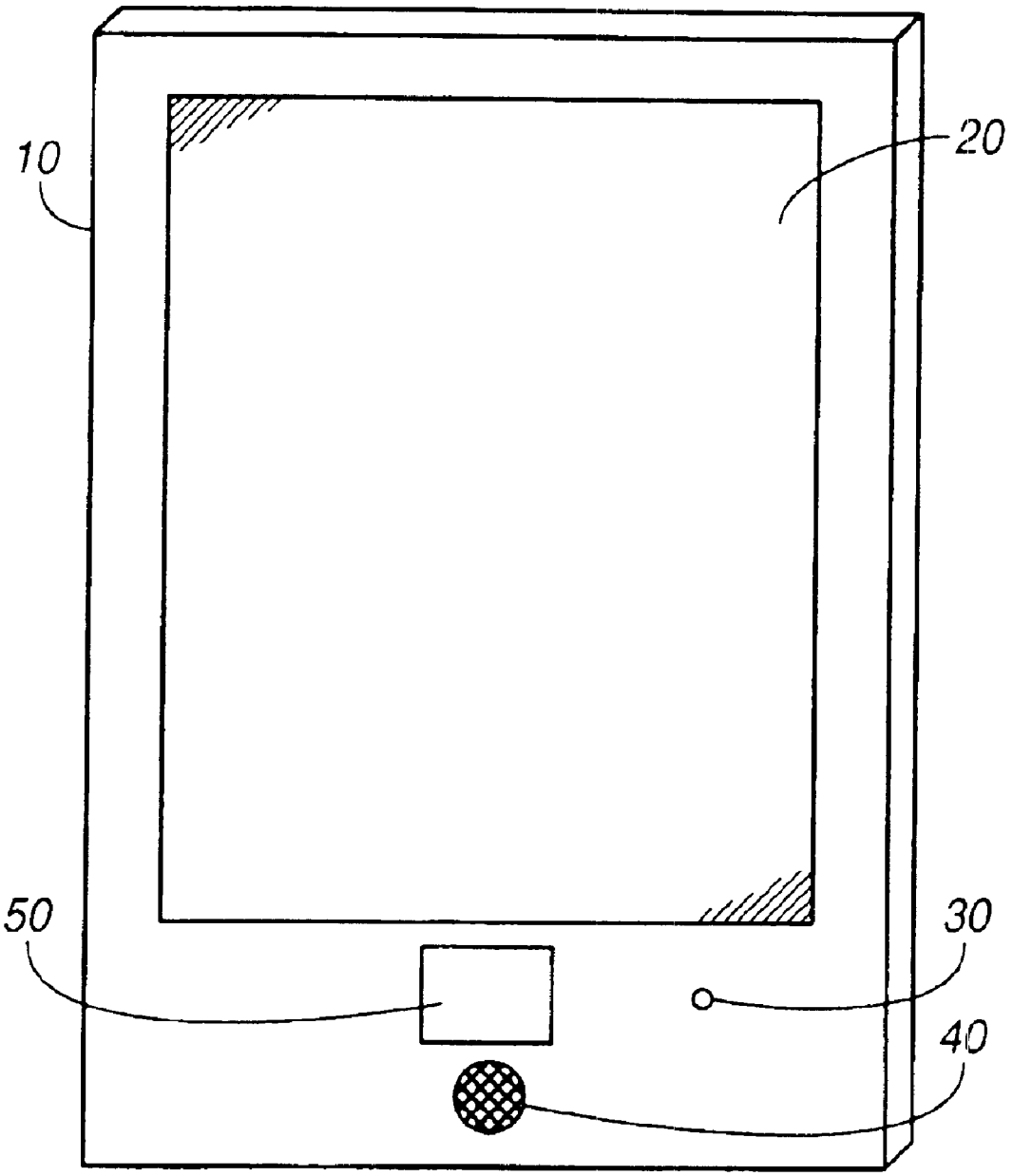
10
20
50
30
40

THEATRICAL ADVERTISING DISPLAY

INDEX TO RELATED APPLICATIONS

This is a continuation of U.S. patent application Ser. No. 10/085,810 filed on Feb. 28, 2002, now U.S. Pat. No. 6,640,475, which is a non-provisional application based on a provisional application Ser. No. 60/296,209 filed on Jun. 7, 2001.

FIELD OF THE INVENTION

The current invention is a display system. More particularly, the current invention provides for an apparatus and method for providing stationary and audio/visual advertising information to a patron of the cinema.

BACKGROUND OF THE INVENTION

The cinema has enjoyed a tremendous popularity in our society. Movies have touched on virtually every theme in an attempt to reach a wide audience. Typically, the theatres advertise their current movie offerings by poster advertisements. These movie posters enjoy a rich history and tradition along with the movies they promote. The movie industry would be very reluctant to give up such a unique part of its heritage. However, as more filmmakers vie for the entertainment dollars of the consumer, there exists a need to entice the consumer to a particular film that goes beyond the ability of the movie poster.

SUMMARY OF THE INVENTION

It is an object of the invention to provide an apparatus that will provide a visual element to the movie advertising. It is a further object of the invention to provide said visual element without eliminating the current movie poster. It is another object of the invention to provide said visual element in a manner where a prospective moviegoer can view said visual element as desired.

BRIEF DESCRIPTION OF THE DRAWING

FIG. 1 shows a standard movie poster display with an adjacent video screen

DETAILED DESCRIPTION OF THE PREFERRED EMBODIMENT

The movie display is the same size and shape as conventionally used movie posters. Incorporated into the display is a video screen. The placement of this screen can be vary depending on a desired configuration. It can be incorporated into the actual frame of the display, or alternatively, can be adjacent to the display. The screen can be a standard CRT monitor or a Liquid Crystal Display (LCD). The monitor would be connected to a single switch, which would start the display. The display would show a segment or segments of the movie as is commonly done in movie advertising. The display can be generated by videotape, digitally stored or any other suitable means in order to display the desired video. The video would be brief and last from 30 seconds to 5 minutes. In one embodiment, the display would be a "trailer" segment as is commonly used in previews in current movie practice. By providing this additional aspect to the on-site display, the current invention would effectively provide the movie consumer with supplemental information that will allow said consumer to make a decision based on more than a visual poster display.

In an alternative embodiment, the display can be used in a retail or rental outlet where video and or DVD products are sold and/or rented.

In yet another embodiment, the screen can contain features similar to that of a screen saver in which advertising may be sold. Said advertising can be stationary or digital display. Said advertising may also be incorporated into the display when activated by the user.

The display could also provide music and sound bites from the event or movie that a poster alone is unable to provide.

The subject invention has a method of use by which a prospective consumer approaches a plurality of display units assembled outside a movie theatre. Display unit 10 houses a standard size event or movie poster 20. The user can select an audio-visual option by pressing a single selection means 30 where the audio will be displayed on a video screen 40 and audio will be available from audio speaker 50. In doing so, the user is provided with the opportunity to gather additional information that will allow for the selection of a particular movie or event.

The subject invention can be used additionally to advertise a concert or special event.

These are provided by way of example and are in no means intended to be limiting the scope of the invention.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A display unit comprising: (a) a housing for a stationary visual display means comprising a movie poster; (b) an audio/visual display means comprising a pre-recorded movie trailer; and (c) a user controlled activation means.

2. The display unit of claim 1 wherein said audio/visual display is provided by a cathode ray tube monitor.

3. The display unit of claim 1 wherein said audio/visual display is provided by a liquid crystal display monitor.

4. The display unit of claim 1 wherein said user controlled activation means is a single switch or button.

5. The display unit of claim 1 wherein the stationary visual display means and audio visual display means are incorporated onto a single housing.

* * * * *